US008446281B2

(12) United States Patent
Birtcher et al.

(10) Patent No.: US 8,446,281 B2
(45) Date of Patent: May 21, 2013

(54) VIRTUAL RECEPTIONIST METHOD AND SYSTEM

(75) Inventors: Brandon R. Birtcher, Irvine, CA (US); Andrew R. Shelansky, Irvine, CA (US); Brandon B. Stuut, Newport Beach, CA (US)

(73) Assignee: Brandon Reid Birtcher Family Trust, Irvine, CA (US)

( * ) Notice: Subject to any disclaimer, the term of this patent is extended or adjusted under 35 U.S.C. 154(b) by 102 days.

(21) Appl. No.: 11/959,393

(22) Filed: Dec. 18, 2007

(65) Prior Publication Data

US 2009/0153325 A1 Jun. 18, 2009

(51) Int. Cl.
*G08B 13/14* (2006.01)

(52) U.S. Cl.
USPC ..... 340/573.1; 340/541; 340/573.4; 348/155; 348/156

(58) Field of Classification Search
USPC ..... 340/541, 537.1, 573.4, 565, 5.1, 340/5.2, 5.52, 5.8; 348/155, 156
See application file for complete search history.

(56) References Cited

U.S. PATENT DOCUMENTS 4,853,678 A 8/1989 Bishop, Jr. et al.
5,097,328 A 3/1992 Boyette
5,673,016 A * 9/1997 Lutes ..... 340/326
5,828,294 A 10/1998 Shank
5,831,534 A 11/1998 Mooney et al.
6,535,132 B2 * 3/2003 Waters et al. ..... 340/573.1
6,697,104 B1 * 2/2004 Yakobi et al. ..... 348/143
6,967,674 B1 * 11/2005 Lausch ..... 348/143
6,987,451 B2 * 1/2006 McKeown et al. ..... 340/541
7,295,106 B1 * 11/2007 Jackson et al. ..... 340/517
7,327,262 B2 * 2/2008 Motteram et al. ..... 340/572.1
2003/0095184 A1 * 5/2003 Lin ..... 348/156
2003/0167176 A1 * 9/2003 Knudson et al. ..... 705/1
2003/0197612 A1 * 10/2003 Tanaka et al. ..... 340/572.1
2004/0111273 A1 * 6/2004 Sakagami et al. ..... 704/277
2004/0160318 A1 * 8/2004 Sasaki et al. ..... 340/522
2004/0203863 A1 * 10/2004 Huomo ..... 455/456.1
2005/0146417 A1 * 7/2005 Sweatte ..... 340/5.2
2005/0261942 A1 * 11/2005 Wheeler ..... 705/3
2006/0100906 A1 * 5/2006 Sweetser ..... 705/2
2006/0255951 A1 * 11/2006 Roeder et al. ..... 340/572.7
2007/0135119 A1 * 6/2007 Hashimoto et al. ..... 455/426.1
2007/0189001 A1 * 8/2007 Nielson et al. ..... 362/16
2007/0242860 A1 * 10/2007 Hasebe et al. ..... 382/118
2007/0247316 A1 * 10/2007 Wildman et al. ..... 340/572.4
2008/0106368 A1 * 5/2008 Vitier ..... 340/5.5
2008/0266130 A1 * 10/2008 Koo et al. ..... 340/686.6
2009/0153325 A1 * 6/2009 Birtcher et al. ..... 340/541
2009/0153335 A1 * 6/2009 Birtcher et al. ..... 340/573.1

* cited by examiner

*Primary Examiner* — Hoi Lau
(74) *Attorney, Agent, or Firm* — Klarquist Sparkman, LLP

(57) ABSTRACT

A method of reception includes detecting that an object has entered a first region of a space at a first time. A time period is measured around the first time. A determination is made whether any object has entered a second region of the space within the time period. Thereafter, a determination is made that the object needs attention when no object is detected entering the second region within the time period.

19 Claims, 8 Drawing Sheets

400A

400A

400B

400C

400D

400E

VIRTUAL RECEPTIONIST METHOD AND SYSTEM

RELATED APPLICATIONS

This application is related to a co-pending application U.S. application Ser. No. 11/959,421, entitled "Notification in a Virtual Receptionist Method and System," to the Birtcher et al., filed on Dec. 18, 2007, the body of which is herein incorporated in its entirety by reference.

BACKGROUND OF THE INVENTION

1. Field of Invention

The present invention relates to the field of guest reception systems. Specifically, the present invention relates to the automated process of receiving guests and providing notification of the arrival of the guest.

2. The Relevant Technology

Many businesses include a separate lobby in which to receive guests or visitors. Typically, the guest would enter the lobby and be greeted by a receptionist that is able to determine what the guest needs. For example, a receptionist is able to effectively bring together the guest and the person with whom the guest is visiting.

In a large business, the receptionist would be kept busy greeting a steady flow of guests coming into the lobby. For extremely busy lobbies, more than one receptionist would be employed. As such, the receptionist is dedicated to the task of greeting and assisting guests that come into the lobby. In addition, other tasks may be assigned to the receptionist, depending on the frequency of the incoming guests. For example, the receptionist may be tasked to take incoming calls, or to perform other minor administrative duties that would enable the receptionist to remain in the lobby in order to still greet guests.

On the other hand, smaller businesses may not have the guest traffic needed to employ a full-time receptionist to monitor the lobby. That is, most of the time, the receptionist is waiting for a guest to arrive within the lobby. To fill in the time, the receptionist typically performs minor tasks that could tolerate interruption and that would also enable the receptionist to remain in the lobby. However, the receptionist is limited in what tasks he or she could accomplish. The receptionist probably could not take on more complicated tasks since this may require desk space holding multiple documents or the handling of sensitive documents, both of which are unnecessary for an incoming guest to view.

As an alternative, some small businesses leave the lobby unattended and hope that the guest is able to actively seek out assistance. For example, the guest would enter the unattended lobby, determine the proper procedures for notifying the business of their arrival, or even find their way through the lobby and into an adjacent area where secretaries or other employees might notice or greet them. While this allows the business to eliminate a receptionist, it requires that the guest perform some action in order to receive assistance. In addition, the incoming guest may feel unwelcome in an unattended lobby as he or she is trying to determine first if the business is open, and second just what is the proper process is for obtaining assistance. While the majority of guests eventually will gain assistance, arguably some good will of the business is lost while the guest is left wondering what to do.

SUMMARY OF THE INVENTION

A method of reception that provides the functions of a virtual receptionist. The method of reception includes detecting that an object has entered a first region of a space at a first time. A time period is measured around the first time. A determination is made whether any object has entered a second region of the space within the time period. Thereafter, a determination is made that the object needs attention when no object is detected entering the second region within the time period.

In another embodiment, a method of reception is disclosed for purposes of providing the functions of a virtual receptionist without any active interaction on the part of the guest. The method of reception includes providing at least two means for detection within a space. A determination is made that a guest entering the space is in need of attention based on interactions of the guest with the at least two means for detection. Thereafter, a notification is provided that the guest has need of attention.

BRIEF DESCRIPTION OF THE DRAWINGS

Exemplary embodiments are illustrated in referenced figures of the drawings which illustrate what is regarded as the preferred embodiments presently contemplated. It is intended that the embodiments and figures disclosed herein are to be considered illustrative rather than limiting.

DETAILED DESCRIPTION OF THE PREFERRED EMBODIMENTS

Figure 1:
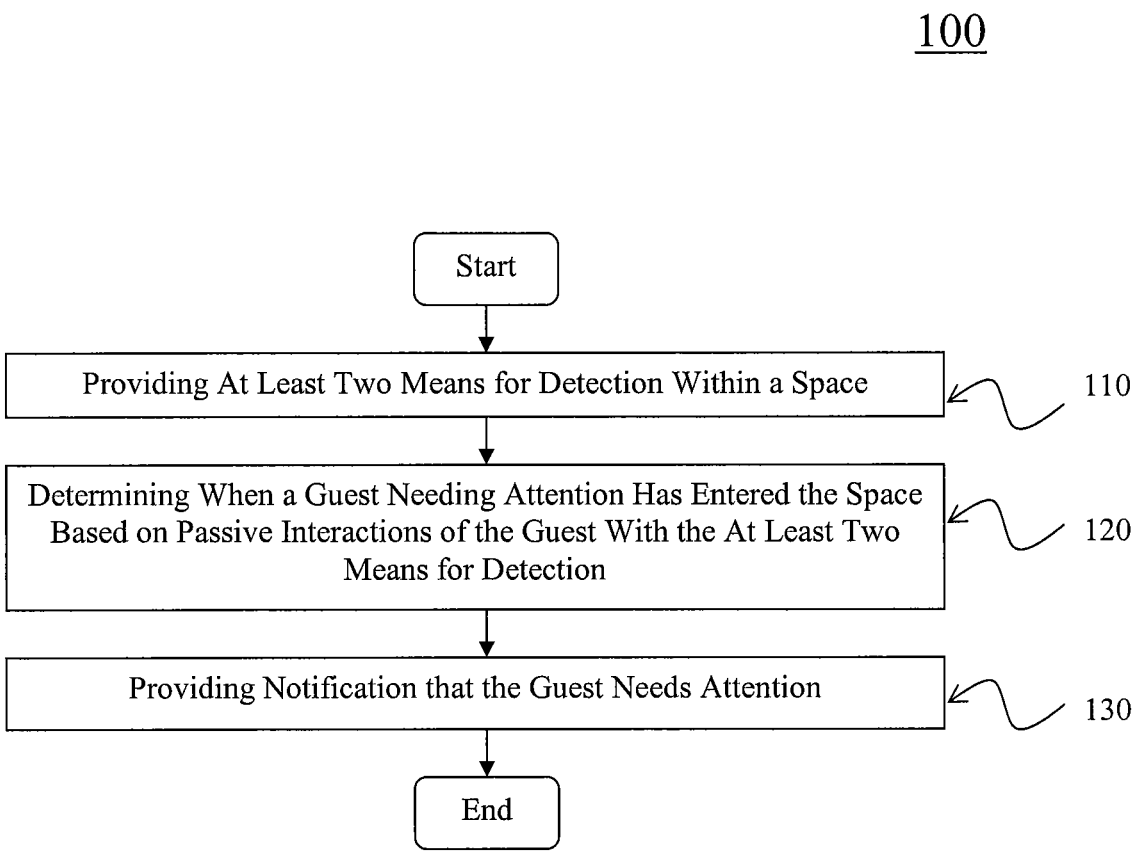
FIG. 1 is a flow diagram illustrating a method for reception, in accordance with one embodiment of the present invention.

Reference will now be made in detail to the preferred embodiments of the present invention, a method and system for recognizing and greeting guests needing attention. While the invention will be described in conjunction with the preferred embodiments, it will be understood that they are not intended to limit the invention to these embodiments. On the contrary, the invention is intended to cover alternatives, modifications and equivalents which may be included within the spirit and scope of the invention as defined by the appended claims.

Accordingly, embodiments of the present invention provide for a virtual receptionist system that automatically determines that a guest needing attention has arrived in a reception area without any active participation by the guests themselves. More particularly, the virtual receptionist system promptly recognizes and greets guests entering a reception area and also provides notification that a guest needing attention has arrived. As such, the virtual receptionist system allows better economic use of employees without dedicating resources to meeting and greeting infrequent guests.

Notation and Nomenclature

Embodiments of the present invention can be implemented on software running on a computer system. The computer system can be a personal computer, notebook computer, server computer, mainframe, networked computer, handheld computer, personal digital assistant, workstation, and the like. For example, a virtual receptionist software program is centrally managed by a computer running a custom software application, in one embodiment. In another embodiment, the computer system includes a processor coupled to a bus and memory storage coupled to the bus. The memory storage can be volatile or non-volatile and can include removable storage media. The computer can also include a display, provision for data input and output, etc.

Some portions of the detailed descriptions which follow are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "detecting," "calculating," and "tracking," or the like, refer to the actions and processes of a computer system, or similar electronic computing device, including an embedded system, that manipulates and transforms data represented as physical (electronic) quantities within the computer system's registers and memories into other data similarly represented as physical quantities within the computer system memories or registers or other such information storage, transmission or display devices.

The Virtual Receptionist

FIG. 1 is a flow diagram 100 illustrating a method for reception, in accordance with one embodiment of the present invention. The method as implemented minimizes the need to employ a full-time receptionist to monitor a reception area. In that manner, the method of flow diagram 100 can be implemented as a virtual receptionist that is capable of recognizing a guest and promptly greeting that guest.

In particular, the method of flow diagram 100 begins at 110 by providing at least two means for detection within a space. In one embodiment, the space is the reception area. In another embodiment, the space includes the reception area, and in still another embodiment, the space includes at least a portion of the reception area.

The detection means includes any type of sensor or mechanism that is able to recognize the presence of an object within a particular region. For instance, the detection means includes motion detection sensors (e.g., infrared detection sensors), laser detection sensors, pressure detection sensors, comparative video detection systems, other comparative detection systems, etc.

At 120, the present embodiment continues by determining when a guest needing attention has entered the space. For instance, a system of motion sensors is implemented to recognize new guests, and to distinguish between people entering the lobby and people leaving the lobby, in one embodiment.

More particularly, detection means within the space are configured such that the passive interactions of a guest with the detection means can be interpreted to determine that a guest needing attention has arrived within a reception area. A more detailed discussion of the interactions of the guest and the detection means is provided in relation to FIG. 2 below. Various exemplary configurations of the detection means within the space are provided in FIGS. 4A-E.

In various embodiments of the present invention, a guest needing attention is recognized without any active participation on the part of the guest. However, other embodiments of the present invention are well suited to providing a determination that a guest needing attention has arrived through the active participation of the guest, such as recognizing a prompt from a guest that he or she needs assistance. In still other embodiments, once a guest is recognized, the guest may be prompted for further information. For instance, the guest may be prompted to provide the name of the person he or she is to visit.

At 130, a notification is provided that a guest needing attention has arrived. More particularly, after a determination is made that a guest needing attention has arrived within a reception area, a notification is provided to one or more employees that the guest needs attention. In this manner, a full-time employee need not be dedicated to the monitoring the reception area for the entry of guests, and instead, the method of flow diagram 100 can be implemented for automatically recognizing that a guest entering the reception area needs attention and providing notification that the guest has arrived.

Figure 2:
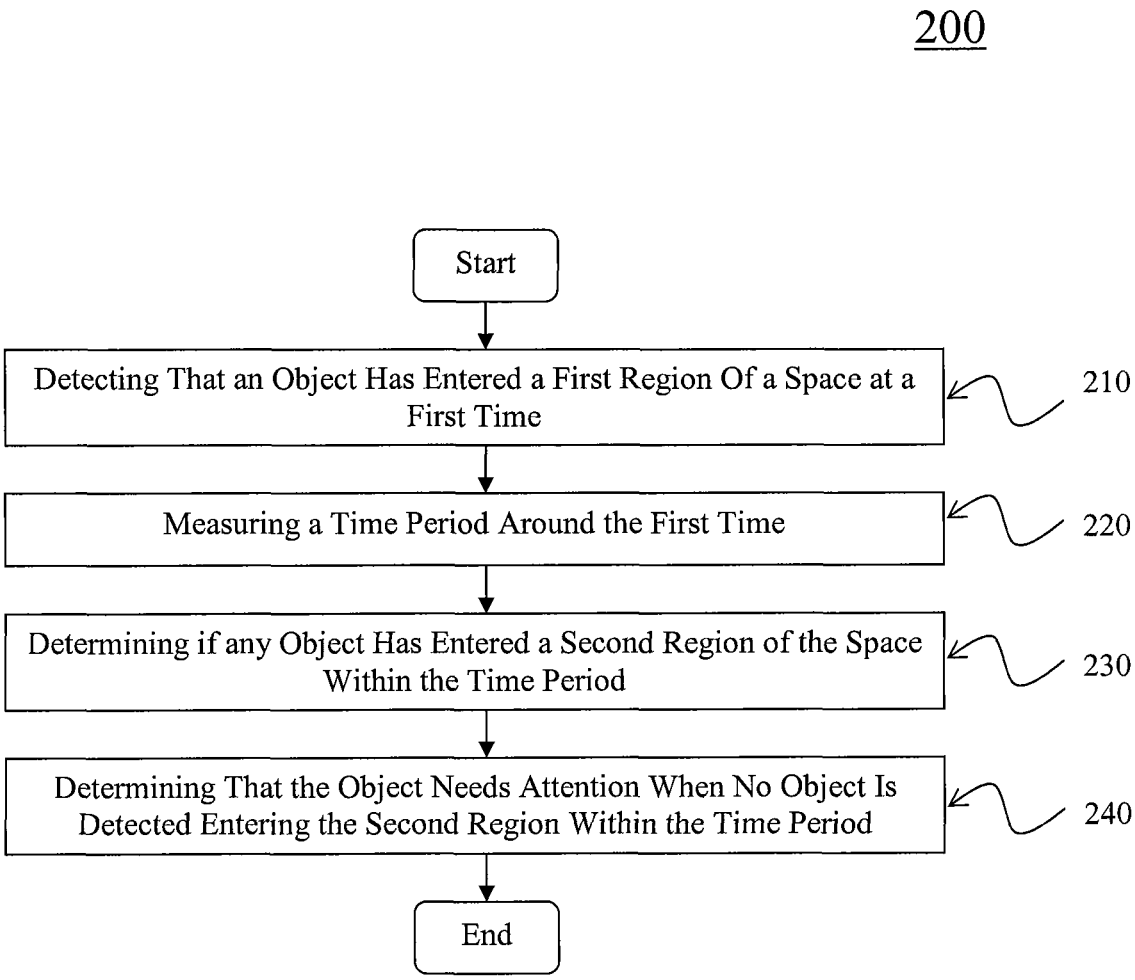
FIG. 2 is a flow diagram illustrating a method of reception that includes detecting object that needs attention, in accordance with one embodiment of the present invention.

FIG. 2 is a flow diagram 200 illustrating a method of reception that includes detecting an object that needs attention, in accordance with one embodiment of the present invention. In particular, the method of flow diagram 200 outlines the process by which an object (e.g., guest) needing attention can be distinguished from an object not needing attention. For example, the method of flow diagram 200 is capable of distinguishing between a person needing assistance and a person not needing assistance, such as an employee who is entering the reception area to access the back office.

While embodiments of the present invention are described in relation to guests needing attention within a reception area, it is intended that other embodiments of the present invention are well suited to situations requiring attention. For instance, embodiments of the present invention are well suited to recognizing situations in which any object is in need of attention, such as a secure lobby that normally does not receive visitors. Any object, including unwanted visitors, entering the secure lobby would require immediate investigation, and embodiments of the present invention are capable of recognizing when the object has entered the secure lobby and providing proper notification of such recognition.

At 210, the present embodiment is capable of detecting that an object has entered a first region of a space at a particular moment in time, a first time. More particularly, the space is representative of an area in which objects (e.g., guests) are likely to enter seeking assistance. For example in various embodiments, the space is the reception area, or may include a reception area, or may include portions of the reception area.

Figure 4A:
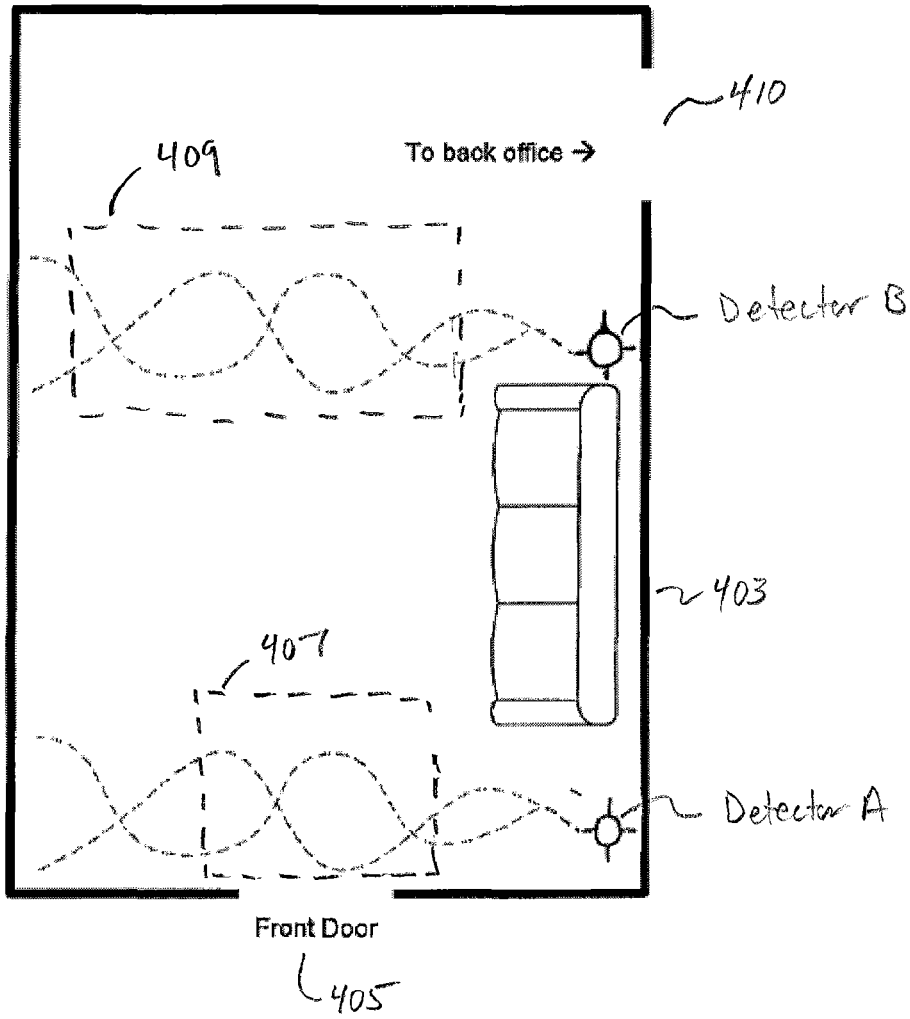
FIG. 4A is an illustration of a configuration of detectors used in a virtual receptionist system that is capable of implementing a method of reception, in accordance with one embodiment of the present invention.
Figure 4B:
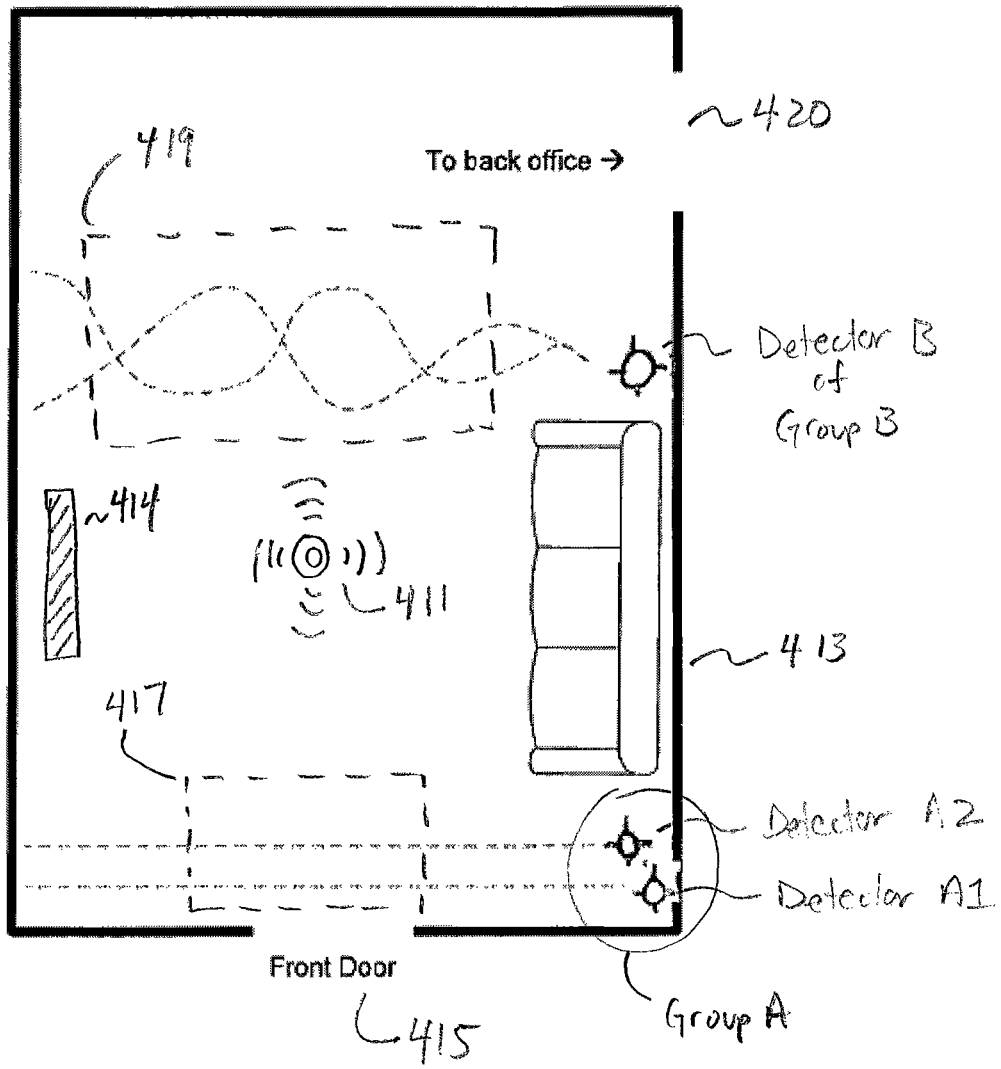
FIG. 4B is an illustration of a configuration of detectors used in a virtual receptionist system that is capable of determining from which direction a guest is arriving within a reception area, in accordance with one embodiment of the present invention.
Figure 4C:
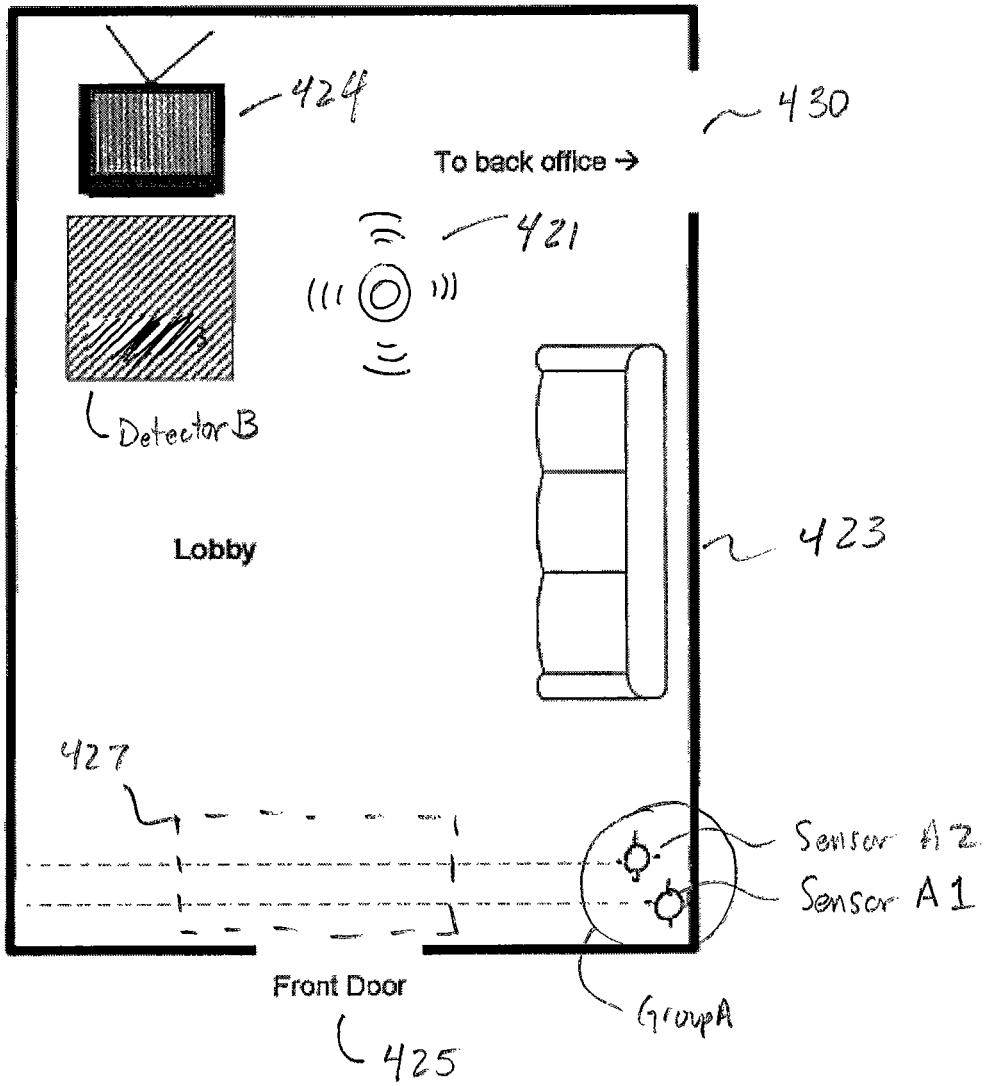
FIG. 4C is an illustration of a configuration of detectors used in a virtual receptionist system that is capable of providing a combination of greetings for guests, in accordance with one embodiment of the present invention.

The space is divided into at least two different regions. The first region within the space is defined as an area in which a guest would normally enter. For example, the first region could include an entryway into the space, or threshold in which a guest would normally cross to enter the space, in embodiments of the present invention. That is, in one embodiment the first region is defined as a contiguous area. FIGS. 4A-C provide exemplary illustrations of the first region including a contiguous area, as will be described below. Detection of an object within the first region gives the first indication that a possible guest needing attention has entered the space.

Figure 4D:
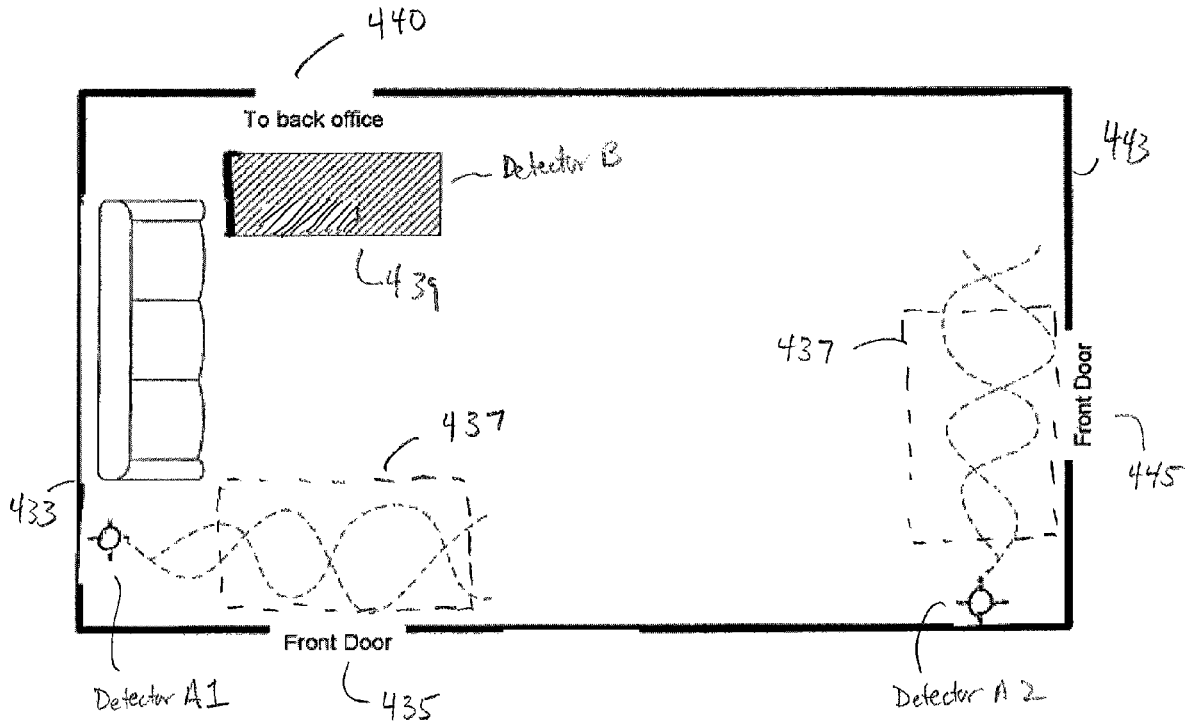
FIG. 4D is an illustration of a configuration of detectors used in a virtual receptionist system that is capable of receiving guests through multiple entryways, in accordance with one embodiment of the present invention.
Figure 4E:
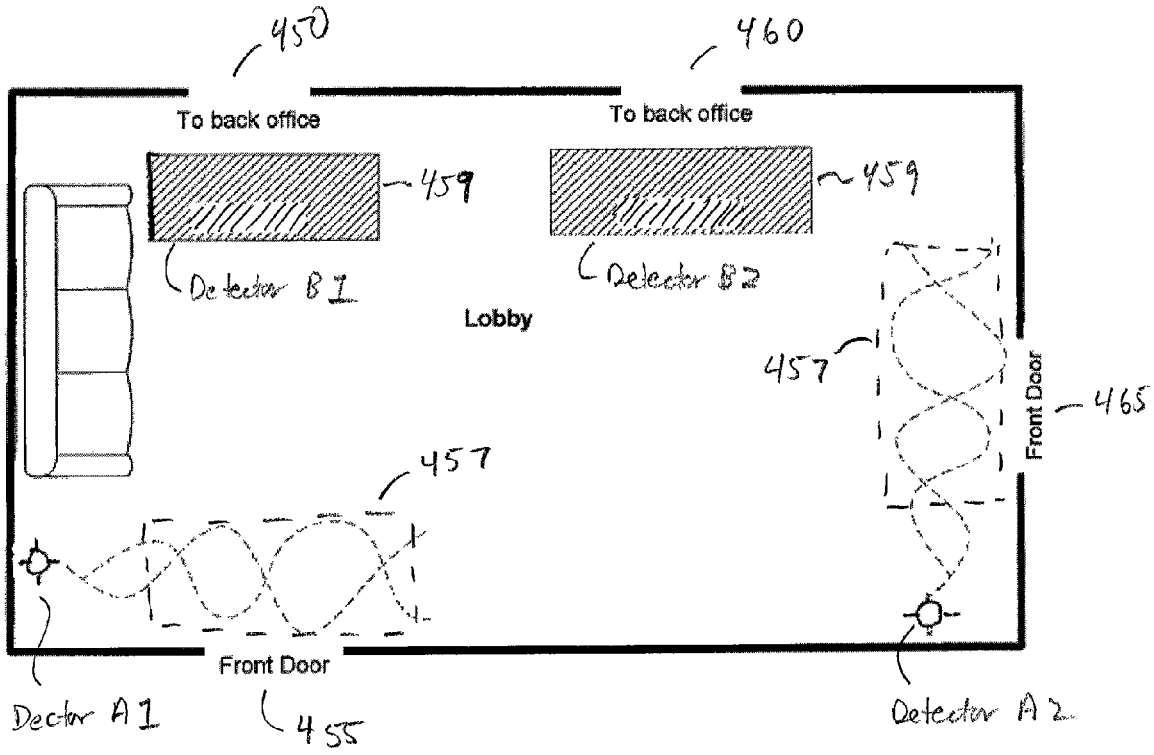
FIG. 4E is an illustration of a configuration of detectors used in a virtual receptionist system that is capable of receiving guests in a reception area including multiple entryways and multiple access portals to interior office spaces, in accordance with one embodiment of the present invention.

In another embodiment, the first region includes multiple and separate areas within the space. For example, the first region includes areas around one or more entryways into the space, or one or more thresholds through which a guest would cross to enter into the space. FIGS. 4D and 4E provide exemplary illustrations of the first region including multiple areas, as will be described below. The present embodiment is able to detect an object in any part of the first region.

At 220, a time period is measured around the first time. Various measurements are envisioned. In one embodiment, the time period includes a continuous block of time. As such, in one embodiment, the time period is measured forward starting from the first time. In another embodiment, the time period is measured backwards starting from the first time. In still another embodiment, the time period is measured so that the first time occurs within the time period, with some time before the first time, and some time after the first time. Measured time in the time period before and after the first time can be of equal duration in one embodiment, or of different durations in other embodiments of the present invention.

At 230, the present embodiment is capable of determining if any object has entered a second region of the space within the time period. The second region is an area within the interior of the space, separate from the first region, in one embodiment. For example, the second region is an area leading to a back office containing interior office space, in one embodiment. In one embodiment the second region is defined as a single, contiguous area. FIGS. 4A-D provide exemplary illustrations of the first region including a contiguous area, as will be described below. In another embodiment, the second regions includes the center of the space. The center of the space provides access to various portals of the space, including the entry portal, the interior portal to the various interior offices, and the welcome desk located within the space.

In another embodiment, the second region includes multiple and separate areas within the space. For example, the second region includes areas around one or more interior entryways allowing access to the interior offices. FIG. 4E provides an exemplary illustration of the second region including multiple areas, as will be described below. The present embodiment is able to detect an object in any part of the second region.

At 240, an object needing attention is determined when no object is detected entering the second region within the time period. More particularly, in one embodiment, the object is a guest or visitor and the space includes a reception area. The guest entering the reception area would typically exhibit a common behavior pattern. That is, with the proper configuration of the first and second regions within the reception area, the present embodiment can determine when a guest needing attention has entered by monitoring the guest's presence in the first and second regions. For example, the second region can be configured such that a guest needing attention would not normally venture into the second region immediately upon entry into the reception area, especially within the time period specified at 220. In one implementation, the guest would typically not proceed to the interior portals that lead to the interior offices, and would wait for assistance, and as such, the second region can be associated with the interior portals, in one embodiment.

On the other hand, employees that enter the reception area to access interior office space normally would not linger in the reception area and would continue deliberately to the back office through the second region. As such, in the above example, an employee that is first detected within the first region would also be detected within the second region within the time period. In this case, the present embodiment is able to determine that the employee as the object would not require attention, since the employee was detected in the first and second regions within the time period, and is walking deliberately to the interior office spaces.

In another embodiment, the second region is associated with a receiving area that may include, for example, the center of the reception area, an interior area of the reception area, a reception desk, or receiving monitor, etc. Again, the guest is not expected to enter the second region within the time period. This occurrence may be ensured with the presentation of an attention getter, or distracter that is indiscriminately provided once an object is detected entering the first region. For example, the attention getter is a video image that is flashed on a monitor, video image that is blinked, an audio blast that is intended to give the potential guest a pause, or a combination of a video image and an audio blast, etc. in embodiments of the present invention. An employee expecting the distraction would not be affected, however, a guest entering the reception area would give pause to investigate the situation, thereby ensuring that the guest would not enter the second region within the time period.

In one embodiment, a notification that the object needs attention is provided without any active participation from the object. That is, the method outlined in FIG. 2 is capable of automatically determining when an object needs attention through the passive participation of the object, such as entering the reception area, and not proceeding to a second region, etc. As such, embodiments of the present invention are able to promptly determine that a guest needs attention, and provide immediate assistance to the guest without the presence or need of a receptionist monitoring the reception area.

Figure 3:
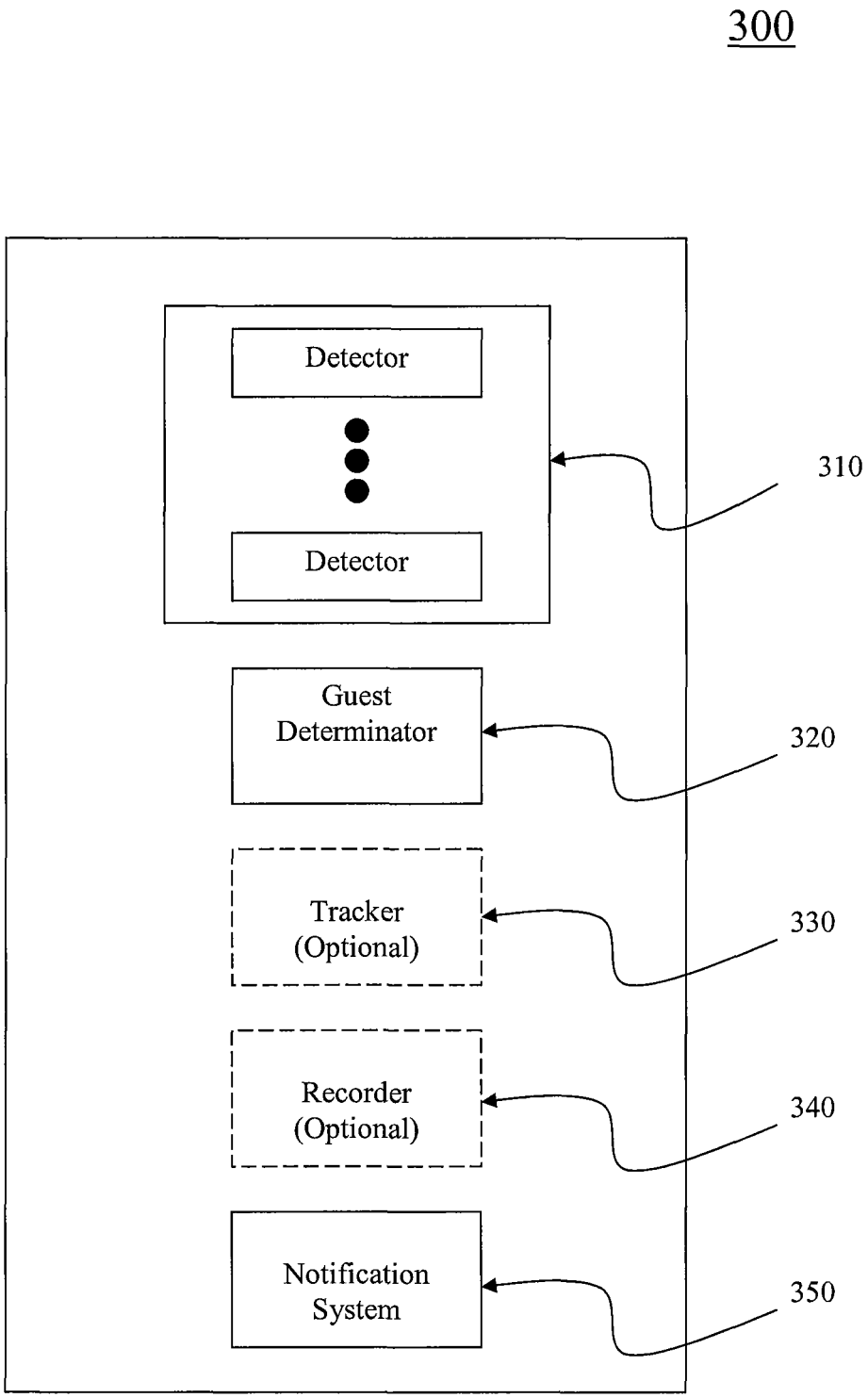
FIG. 3 is a diagram of a system that is capable of implementing a method of reception, in accordance with one embodiment of the present invention.

FIG. 3 is a block diagram of a system 300 that is capable of implementing methods of reception described both in FIGS. 1 and 2, in accordance with one embodiment of the present invention. The system functions as a virtual receptionist thereby eliminating the need to dedicate human resources to monitor a reception area for guests.

In one embodiment, system 300 is controlled by a controller (not shown) running a software application that implements the virtual receptionist software program integrating the components of system 300. This software program is operable for allowing users to specify the various behaviors of each component, select welcome messages from a variety of different media sources, and monitor and analyze reception area traffic.

As shown, system 300 includes at least two detectors 310 for detecting an object within a space. As described previously, the detectors are capable of detecting the presence of the object through various means. For instance, the detectors can be motion detectors, heat detectors, pressure sensitive detectors, impulse comparator modules (e.g., video, audio, etc.), etc.

System 300 includes a guest determinator coupled to the at least two detectors for determining when an object needing attention has entered the space based on interactions of the object with the at least two means for detecting. The guest determinator receives detection information as to the presence or non-presence of objects within regions of the space. As described previously in relation to FIGS. 1 and 2, the guest determinator is capable of detecting when an object needs attention (e.g., guest) based on the timing of object's presence or non-presence within regions of the space.

In addition, system 300 optionally includes a tracker 330 coupled to the guest determinator 320 that is capable of tracking objects in the space. More particularly, tracker 330 is able to track the number of objects in the space needing attention, and is also capable of tracking the number of objects in the space not needing attention (e.g., employees). In this manner, system 300 is able to provide information for monitoring and analyzing reception area traffic.

For example, the tracker 330 is able to log date, time and relevant information for the following exemplary activities: motion sensor activations, arrivals, departures, video playback events, audio playback events, button activity, software configuration access, configuration changes, system errors, system online/offline, network connectivity changes, error notifications, etc.

System 300 also optionally includes a recorder 340 coupled to guest determinator 320 that is able to record various information, including tracking information supplied from tracker 330. In addition, recorder 340 is able to record various other information, such as timing information, configuration information, etc. that is useful for configuring the at least two detectors 310.

For example, recorded information can be compiled into reports that include information on the following: relevant system errors, major system configuration changes, number of visitors, average visitor wait, number of video/audio playbacks, and employee traffic, etc.

Further, system 300 also includes a notification system 350 coupled to the guest determinator 320 that is capable of providing notification that the object needs attention. For instance, once the guest determinator 320 determines that an object needs attention, the notification system 350 is capable of providing notification of such event. For instance, in one embodiment, notification system 350 provides notification that requires some response by a person or entity. In another embodiment, notification system 350 provides notification to the proper employee or employees within a business that are tasked to greet visitors. Upon receiving the notification, the employees can provide immediate assistance to the object needing attention.

In another embodiment, system 300 includes a video recorder (not shown) for capturing video images of the guest. The video images or recordings of the guest can be captured and stored for immediate use or for later use. For example, a video image of the guest may be presented by the notification system along with the notification to provide some identification of the guest. In addition, these and other video images may be stored and retrieved at a later time to perform traffic analysis. Also, these video images may be used for comparative analysis between images for purposes of guest detection, as is described more fully below.

FIGS. 4A-E provide exemplary illustrations of various configurations of detectors for use in a virtual receptionist system that is capable of implementing an automated method of reception, in accordance with embodiments of the present invention. In each of these configurations, the sensors are divided into two groups. For example, one or more sensors are grouped in Group A, and one or more sensors are grouped into Group B. Each additional sensor in a group provides added functionality, such as directional information, as will be described below. In other embodiments of the present invention, the sensors are divided into more than two groups. Each additional grouping of sensors provides an added functionality, such as tracking of individuals within the reception area.

FIG. 4A is an illustration of an exemplary configuration of detectors in a space defining the reception area 400A, in accordance with one embodiment of the present invention. In one embodiment, the configuration of FIG. 4A can be used to describe the core functionality of the system 300 having virtual receptionist functionality.

The configuration shown includes two detectors: detector A and detector B. Detector A monitors the region 407 surrounding the front door 405 of the reception area 400A. Region 407 is analogous to the first region described in 210 of FIG. 2. As described previously, detectors A and B are representative of any number of detection means (e.g., infrared sensors, laser sensors, pressure sensitive sensors, etc.). For example, in one embodiment, detector A is a motion sensor that is mounted on the wall 403 just inside the reception area 400A. Detector A is pointed perpendicular to the direction a person would walk through the entryway defined by the front door 405 (e.g., parallel with the front door 405). As such, detector A is able to detect when an object (e.g., person) enters region 407.

Detector B monitors the region 409, which defines an interior area some distance from the front door 405 of the reception area 400A. Detector B can be mounted on wall 403. Region 409 is analogous to the second region described in 230 of FIG. 2. As shown, regions 407 and 409 define distinct regions within reception area 400A.

The information obtained from detectors A and B are sent to the guest determinator 320 of system 300 to determine if an object needs assistance. The virtual receptionist system 300 is able to apply a set of logical rules to determine the meaning of various detector activities. For instance, different combinations of detectable events will represent a guest arriving, an employee arriving, a person (guest or employee) leaving, or a person pacing in the lobby.

For example, if detector A is triggered, and detector B is triggered within a time period (e.g., 4 seconds), this would indicate that an employee is walking through the reception area to access the back office through interior door 410. The employee typically would not linger within the reception area 400A, and would deliberately walk to the interior door 410 through the second region 409.

In addition, if detector A is triggered, but detector B is not triggered within the same time period (e.g., 4 seconds), this would indicate that a guest is in the reception area 400A. The guest would not typically walk to the interior door 410 to access the back office, but would instead linger in the reception area 400A waiting for assistance.

As a further example, if detector B is triggered first, and then detector A is triggered within a time period (e.g., 15 seconds), this indicates that someone is leaving the office. In this situation, the present embodiment is able to distinguish a person leaving the reception area 400A from a person entering the reception area 400A and possibly needing assistance. As such, in this situation notification is not provided even if the detector A is triggered.

In addition, if detector B is triggered, and detector A is not triggered within a time period (e.g., 15 seconds), then a person either has moved from inside the office to the reception area 400A, or from the reception area 400A to the back office through the interior door 410.

While the embodiment shown in FIG. 4A uses two detectors, other configurations using additional detectors may provide significantly increased accuracy in determining whether an object requires assistance. Examples of these other configurations are shown in FIGS. 4B-E.

FIG. 4B is an illustration of an exemplary configuration of detectors in a space defining the reception area 400B, in accordance with one embodiment of the present invention. In one embodiment, the configuration of FIG. 4B can be used to describe the functionality of the system 300 having virtual receptionist functionality.

The configuration shown in FIG. 4B includes two groups of detectors: Group A and Group B. Group A includes detectors A1 and A2. Group B includes detector B. The function and interactions of the groups of detectors are similar to the two detector configuration of FIG. 4A. That is, each group of detectors can be thought to function as a single detector. However, multiple detectors in a particular group also adds additional functionality, as will be described below.

The detectors of Group A monitors the region 417 surrounding the front door 415 of reception area 400B. Region 417 is analogous to the first region described in 210 of FIG. 2. While the detectors shown in FIG. 4B are representative of any number of detection means, detectors A1 and A2 are laser beam motion sensors. In addition, the functions of the detectors in Group A can be provided as a whole from one detector or multiple detectors, in embodiments of the present invention. For example, although FIG. 4B illustrates the use of two detectors A1 and A2 in Group A, the function of the two detectors A1 and A2 can be performed by a single detector in embodiments of the present invention.

As shown, detector A1 is mounted on the wall 413 just inside the reception area 400B, and is pointed perpendicular to a direction a person would walk through the entryway defined by the front door 415 (e.g., parallel with the front door 415). In addition, detector A2 is similarly configured as detector A1, but is mounted on wall 413 further within the interior of reception area 400B. For example, detector A2 is mounted a few inches further into the reception area 400B than detector A1.

Information from any of the detectors in Group A can be used to determine if an object is present in region 417, and as such, Group A would act a single detector, such as that shown in FIG. 4A. However, as a multi-detector group, detectors A1 and A2 in Group A in combination are able to detect when an object (e.g., person) enters region 417 or exits region 417. More specifically, detectors A1 and A2 provide directional information as to the movement of a person through front door 415.

Detector B in Group B monitors the region 419, which defines an interior area some distance from the front door 415 of the reception area 400B. Region 419 is analogous to the second region described in 230 of FIG. 2.

As previously stated, the detectors in Group A and B in FIG. 4B have the same functionality as the detector configuration of FIG. 4A, and can detect when a person is entering the reception area 400B, determine if that person is an employee or is someone who needs assistance. However, because Group A includes two detectors, the configuration in FIG. 4B can also help distinguish when a person is entering or leaving the reception area 400B.

For instance, if detector A1 is triggered and then detector A2 is triggered, this would indicate that a person has walked in the front door 415. Without more information, this person may or may not need assistance. As described previously, this information is gained from the interaction of the person with detector B, as noted within a time period. Specifically, if the person triggers detector B within a time period, that person is assumed to be an employee, or one who does not need assistance. On the other hand, if the person does not trigger detector B within a time period, then the person is determined to need assistance.

As described previously, an attention getter or distraction mechanism may be employed to further delay the person walking in to the reception area. For instance, a video image may be flashed on the monitor 414 that is designed to grab the attention of the person walking through the front door 415. In addition, an audio sound may be emitted from the audio system 411 to distract and give the person pause. The audio system 411 may be physically attached to monitor 414, or separate from monitor 414, but is configurable to interface with the monitor 414 to provide audio for video programming. Also, a combination of video and audio stimuli may be presented to give the person pause.

In addition, if detector A2 is triggered and then detector A1 is triggered, this would indicate that a person is walking out the front door 415. In this situation, even though detectors in Group A have been triggered, because directional information is provided, a person walking out of the reception area 400B would not be confused with a person walking into the reception area 400B and possibly needing assistance, as may be encountered in the configuration of FIG. 4A, when a person lingering in the reception area does not trigger detector B but does trigger detector A when exiting.

In addition, the monitor 414 can be used to optionally provide standby video for periods when guests are waiting or when no guests are currently being detected, in one embodiment. Basically, the standby video is playing whenever there is no welcome greeting being played. In another embodiment, standby audio is played on audio system 411 instead of the standby video for period when guests are waiting or when no guests are being detected.

Additionally, a welcome greeting may be provided once it is determined that an object (e.g., guest) needs attention. For instance, a welcome video message may be played on the monitor 414, or a welcome video message combined with audio from system 411 may be played, or a welcome audio message may be played on system 411.

In one embodiment, the welcome video is displayed in full screen mode. That is, the welcome video is played on the entire screen of the monitor 414. In another embodiment, the welcome video is displayed in split screen mode along with the standby video. In that way, waiting guests will not have the standby video disrupted.

In one embodiment, the welcome greeting is delayed once it is determined that the guest has arrived and needs attention. A brief delay will give a guest the opportunity to fully enter the reception area 400B, and become aware of the monitor 414 before the welcome greeting starts. This ensures that the guest will see the welcome video, and avoids startling the guest mid-stride.

Further, is may be important to not startle, disrupt, or annoy any guests or employees. As such, a welcome greeting is not necessary every time a guest is detected. For this reason, embodiments of the present invention provide for various options that allow adjustments to the timing and frequency of welcome greetings. For instance, in one embodiment, a maximum number of greetings are provided within a certain time period. That is, a plurality of guests is detected entering the reception area 400B, and a limit is set on the number of greetings played for the plurality of guests. As such, the present embodiment sets how often a greeting can be played. This setting can be user selectable, in one embodiment. Setting a maximum frequency can help prevent guests waiting in the lobby from the annoyance of repeated greetings as each new guest arrives.

In addition, as described previously, an abort function may be provided within the reception area 400B, in one embodiment. Under normal circumstances, activating an abort function (e.g., abort button) will prevent any greeting from beginning or will stop any greeting that is currently being played. Also, the greeting function can be disabled for a selectable time period. For example, an employee working within the reception area 400B may be mistaken for a guest needing attention. By activating the abort function, the process for recognizing a guest and providing notification that a guest needs attention is disabled.

FIG. 4C is an illustration of an exemplary configuration of detectors in a space defining the reception area 400C, in accordance with one embodiment of the present invention. In one embodiment, the configuration of FIG. 4C can be used to describe the functionality of system 300 providing virtual receptionist functionality.

The configuration shown in FIG. 4C is similar to the configuration of FIG. 4B in that two groups of detectors (Group A and Group B) are shown. In particular, similar to FIG. 4B, Group A in FIG. 4C includes detectors A1 and A2 mounted on wall 423. Group B includes detector B, which is shown as a pressure sensitive pad.

The functions and interactions of the groups of detectors in FIG. 4C are similar to the multi-detector configuration of FIG. 4B. That is, the detectors in Group A provide information that can be used to determine if a person is walking into reception area 400C or walking out of reception area 400C. As such, similar to the guest recognition functionality described in relation to FIGS. 4A and 4B, the present embodiment can determine that an object (e.g., person) needs attention when the object is detected by the detectors in Group A and no object is detected by detector B within a certain time period, in one embodiment.

In another embodiment, the configuration of FIG. 4C may require additional participation on the part of the person. That is, a person may be instructed to walk into the area monitored by detector B. For instance, in one embodiment, once a person is detected coming into the reception area 400C, they are prompted to walk up to monitor 424 to view a welcome video, in one embodiment. In this case, detector B would be triggered. For example, the prompt is an audio prompt from the speaker 421, in one embodiment, or the prompt is a video prompt from the monitor 424, or the prompt may be a combination of both. In still another embodiment, a placard providing instructions to view monitor 424 for a welcome video is placed over the area monitored by detector B.

Because of the added sensitivity of the detectors in Group A, the region defined by detector B can be smaller. That is, in the present embodiment, an employee walking into the reception area 400C need not trigger detector B. The employee would ignore the prompt to view the monitor 424, and would not trigger detector B.

On the other hand, a guest walking into the reception area 400C would follow the instructions to walk up to monitor 424, thereby triggering detector B. In this case, the present embodiment is able to determine that guest needs attention when the guest has triggered detector B in front of monitor 424 because of prompting. More specifically, the present embodiment is able to determine that a guest needs assistance when the detectors in Group A indicate that the guest has walked into the reception area 400C, and also when detector B is triggered within a time period.

In still another embodiment, the system 300 can be adapted with the operation provided above to provide the functionality of the configuration of FIG. 4C. That is, in one embodiment, it can be determined that the object needs assistance when both detector B is not triggered within a time period, but is eventually triggered. As such, the triggering of detector B indicates that a guest needs assistance.

Furthermore, in another embodiment, additional activity on the part of the guest is requested. For example, once the guest is prompted to walk up to monitor 424, additional information from the guest may be requested, such as the name of the guest, and the name of the person the guest wishes to visit.

FIG. 4D is an illustration of an exemplary configuration of detectors in a space defining the reception area 400D, in accordance with one embodiment of the present invention. The configuration as shown in FIG. 4D illustrates the use of a virtual receptionist system 300 in a reception area 400D with multiple entryways.

The configuration shown in FIG. 4D includes two groups of detectors Group A and Group B. Group A includes detectors A1 and A2. Group B includes detector B. The two groups of detectors act to detect when an object has entered the reception area 400D that includes more than one entryway, but a single interior entryway to the back office. The function and interactions of the groups of detectors are similar to the two detector configuration of FIG. 4A. That is, each group of detectors can be thought to function as a single detector.

The detectors of Group A monitors region 437. Region 437 is analogous to the first region described in 210 of FIG. 2, and may cover one or more entryways associated with one or more front doors. As described previously, the detectors A1 and A2 are representative of any number of detection means, and are shown for purposes of illustration as infrared motion sensors. Region 437 is divided into multiple areas that cover the entryways associated with all of the front doors leading into and out of reception area 400D. For instance, region 437 includes the entryway associated with front door 435. For example, detector A1 is mounted on wall 433 just inside reception area 400D, and is pointed perpendicular to a direction a person would take when entering the reception area 400D through front door 435. Also, detector A2 is mounted on wall 443 just inside reception area 400D, and is also pointed perpendicular to a direction a person would take when entering the reception area 400D through front door 445.

Any of the detectors in Group A can act to determine if an object is present in region 437, and as such, Group A would act a single detector. As such, a triggering of either the detector A1 or detector A2 would indicate that a possible guest has entered the reception area 400D.

While FIG. 4D only shows one detector associated with each front door 435 and 445 in the present embodiment, other embodiments are well suited to having multiple detectors configured to monitor the combined entryway associated with one or more of the front doors 435 and 445. In that way, directional information of movement of objects can be obtained, as described previously in relation to FIG. 4B, or additional information may be obtained, such as tracking of individuals in the reception area 400C. That is, configurations of detectors can be mixed to make new configurations suitable to providing virtual receptionist functionality.

Detector B in Group B monitors region 439, which defines an interior area some distance from the front doors 435 and 445 of reception area 400D. Region 439 is analogous to the second region described in 230 of FIG. 2. In FIG. 4D, detector B is shown as a pressure sensitive pad and is representative of any number of detection means for detecting the presence of an object.

The detectors in Group A and B have the same functionality implemented by the detector configurations of FIG. 4A-C, in embodiments of the present invention. As such, the system 300 that implements virtual receptionist functionality is able to apply a set of logical rules to determine when a person is entering the reception area 400D, and determine if that person needs assistance. However, because Group A includes multiple detectors, the configuration of FIG. 4D can service multiple and separate entryways.

For instance, if detector A1 or A2 is triggered and detector B is triggered within a time period (e.g., 4 seconds), this would indicate an employee is accessing the back office through interior door 410. On the other hand, if detector A1 or A2 is triggered, but detector B is not triggered within the same time period (e.g., 4 seconds), this would indicate that a guest is in the reception area 400D and needs assistance. Also, if detector B is triggered first, and either detector A1 or A2 is triggered within a time period (e.g., 15 seconds), this indicates that someone is leaving the office. In addition, if detector B is triggered first, and neither detector A1 or A2 is triggered within a time period, then someone has moved from inside the back office to the reception area 400D or from the reception area 400D to the back office.

FIG. 4E is an illustration of an exemplary configuration of detectors in a space defining the reception area 400E, in accordance with one embodiment of the present invention. The configuration as shown in FIG. 4E illustrates the use of a virtual receptionist system 300 in a reception area 400E with multiple entryways and multiple interior doorways.

The configuration shown in FIG. 4E is similar to that of FIG. 4D, and includes two groups of representative detectors Group A and Group B. Group A includes detectors A2 and A2 that monitors region 457. Region 457 is divided into multiple areas that covers the entryways associated with front doors 455 and 465 leading into and out of reception area 400E. The present embodiment is easily adaptable to monitor more than two entryways.

Group B includes detectors B1 and B2. The detectors of Group B monitor interior region 459, which is analogous to the second region described in 230 of FIG. 2. Region 459 is divided into multiple areas that cover the entryways associated with all of the interior doors leading between the back office and the reception area 400E. As shown in FIG. 4E, detectors B1 and B2 are pressure sensitive pads, and are representative of any number of detection means for detecting the presence of an object. For example, detector B1 is shown as a pressure sensitive pad and is located just inside of door 450 providing access to the back office from reception area 400E. Also, detector B2 is shown as a pressure sensitive pad and is located just inside door 460 providing access to the back office from reception area 400E.

The detectors in Group A and B of FIG. 4E have the same functionality as the detector configuration of FIGS. 4A-D, in embodiments of the present invention. As such, the system 300 that implements virtual receptionist functionality is able to apply a set of logical rules to determine when a person is entering the reception area 400E, and determine if that person needs assistance. However, because both Groups A and B include multiple detectors, the configuration of FIG. 4E can service multiple and separate entryways and interior walkways that lead to the back office.

For instance, in FIG. 4E if detector A1 or A2 is triggered and either detector B1 or B2 is triggered within a time period (e.g., 4 seconds), this would indicate an employee is accessing the back office through one of the interior doors 450 or 460. On the other hand, if detector A1 or A2 is triggered, but none of detectors B1 or B2 is triggered within the same time period (e.g., 4 seconds), this would indicate that a guest is in the reception area 400E and needs assistance. Also, if either of the detectors B1 or B2 is triggered first, and either detector A1 or A2 is triggered within a time period (e.g., 15 seconds), this indicates that someone is leaving the office. In addition, if either of the detectors B1 or B2 is triggered first, and neither detector A1 or A2 is triggered within a time period, then someone has moved from inside the back office to the reception area 400E or from the reception area 400E to the back office, and would not trigger any notification that a guest needs assistance.

Accordingly, embodiments of the present invention provide for a virtual receptionist system that automatically determines when an object, such as a guest, has entered a reception area and needs attention, without any active participation on the part of the guest.

While the methods of embodiments illustrated in flow charts 1 and 2 show specific sequences and quantity of operations, the present invention is suitable to alternative embodiments. For example, not all the operations provided for in the methods presented above are required for the present invention. Furthermore, additional operations can be added to the operations presented in the present embodiments. Likewise the sequences of operations can be modified depending upon the application.

A method and system for implementing a virtual receptionist system, is thus described. While the invention has been illustrated and described by means of specific embodiments, it is to be understood that numerous changes and modifications may be made therein without departing from the spirit and scope of the invention as defined in the appended claims and equivalents thereof. Furthermore, while the present invention has been described in particular embodiments, it should be appreciated that the present invention should not be construed as limited by such embodiments, but rather construed according to the below claims.

What is claimed:

1. A method of distinguishing a guest from a non-guest in a receiving area for guests using a virtual receptionist system, comprising:

directly detecting that a new object has entered a first region of the receiving area, the first region of the receiving area being an area accessible to non-guests and guests, the new object being an entering person;

directly detecting whether the object has entered a second region of the receiving area, the second region of the receiving area being an area generally restricted to non-guests, the first and second regions of the receiving area being physically separate from one another;

establishing a time period within which a typical non-guest would travel a distance between the first and second regions;

identifying the object as a guest that needs attention when the object is not detected to have entered the second region within the time period or as a non-guest that does not need attention when the object is detected to have entered the second region within the time period;

delivering a greeting to the object if the object is identified as a guest; and delivering a notification to one or more persons at a location outside of the receiving area if the object is identified as a guest, the notification informing the one or more persons that a guest has entered the receiving area, wherein the acts of directly detecting the entry of the object into the first and second regions comprise directly detecting movement of the entering person in the first and second regions.

2. The method of claim 1, wherein the first region comprises an entryway to the receiving area.

3. The method of claim 1, wherein the first region comprises a plurality of entryways to the receiving area.

4. The method of claim 1, wherein detecting an object comprises:

detecting that the object is moving in a direction towards the second region from the first region.

5. The method of claim 1, wherein the second region comprises at least one interior region in the receiving area.

6. The method of claim 1, further comprising:

providing a means for grabbing the attention of the object after the object is detected in the first region.

7. The method of claim 1, wherein the greeting comprises a welcome video message.

8. The method of claim 1, wherein the notification that the object needs attention is provided without any active participation from the object.

9. The method of claim 1, further comprising:

tracking a number of objects in the receiving area needing attention; and tracking a number of objects in the receiving area not needing attention.

10. A method of reception, comprising:

providing at least two detecting means within a receiving area for receiving guests, the at least two detecting means being spaced apart from one another and including a first detecting device configured to detect the presence of an object in a guest area of the receiving area and a second detecting device configured to detect the presence of the object in a non-guest area of the reception area;

determining whether a guest needing attention has entered the receiving area based on passive interactions of the object with the at least two detecting means within a predetermined amount of time, the at least two detecting means being configured to detect a physical presence of the object; and providing a notification that the guest needs attention, wherein the receiving area is a lobby of a business.

11. The method of reception of claim 10, wherein the determining when a guest needing attention has entered the receiving area comprises:

detecting that the object has entered a first region within the receiving area;

determining if the object has entered a second region of the receiving area within the predetermined amount of time; and determining that the object is the guest when no object is detected entering the second region within the predetermined amount of time.

12. The method of reception of claim 10, wherein the determining when a guest needing attention has entered the receiving area comprises:

detecting that the object has entered a first region within the receiving area;

determining if the object has entered a second region of the receiving area within the predetermined amount of time; and determining that the object is the guest when any object is detected entering the second region within the predetermined amount of time.

13. The method of claim 10, further comprising:

providing a means for aborting the method of reception.

14. The method of claim 10, further comprising:

detecting a plurality of guests entering the receiving area; and limiting the number of greetings for the plurality of guests.

15. The method of claim 10, further comprising:

prompting the guest for information.

16. A system for reception, comprising:

at least two spaced-apart detectors for directly detecting the arrival of an unidentified person within a receiving area for guests based on a physical presence of the person within the receiving area, the at least two spaced-apart detectors including a first detector positioned at an area accessible to guests and non-guests, and a second detector positioned at an area generally restricted to guests;

a guest determinator coupled to the at least two detectors for determining when the person arriving in the receiving area is a guest needing attention based on interactions of the person with less than all of the at least two detectors which provide information about whether the person has moved between the at least two detectors; and a notification delivery system configured to deliver notifications of the arrival of the person within the receiving area to one or more other persons located outside of the receiving area when the guest determinator determines that the person requires attention.

17. The system of claim 16, further comprising:

a data logging device coupled to the guest determinator for tracking the number of persons in the receiving area needing attention and for tracking the number of persons in the receiving area not needing attention.

18. The method of claim 1, wherein the acts of passively detecting the entry of the object into the first and second regions comprises directly detecting a physical presence of the entering person using one or more detectors configured to detect movement of the object.

19. The system of claim 16, wherein the at least two spaced-apart detectors comprise motion sensors.

* * * * *